United States Patent [19]

Hickey et al.

[11] Patent Number: 4,614,930

[45] Date of Patent: Sep. 30, 1986

[54] RADIALLY MAGNETIZED CYLINDRICAL MAGNET

[75] Inventors: John S. Hickey, Burnt Hills; Peter B. Roemer, Schenectady, both of N.Y.

[73] Assignee: General Electric Company, Schenectady, N.Y.

[21] Appl. No.: 715,709

[22] Filed: Mar. 25, 1985

[51] Int. Cl.[4] ..... H01F 7/02

[52] U.S. Cl. ..... 335/302; 335/306

[58] Field of Search ..... 335/284, 306, 301, 304, 335/302; 324/318, 320, 321

[56] References Cited

U.S. PATENT DOCUMENTS

| | | | |
|---|---|---|---|
| 2,272,766 | 2/1942 | Corson et al. | 335/302 X |
| 3,237,059 | 2/1966 | Meyerer | 335/306 X |
| 4,355,236 | 10/1982 | Holsinger | 250/396 |
| 4,471,306 | 9/1984 | Edelstein et al. | 324/309 |
| 4,498,048 | 2/1985 | Lee et al. | 324/307 |

FOREIGN PATENT DOCUMENTS

| | | | |
|---|---|---|---|
| 3312626 | 10/1984 | Fed. Rep. of Germany . | |
| 165607 | 12/1980 | Japan | 335/284 |

*Primary Examiner*—George Harris

*Attorney, Agent, or Firm*—Marvin Snyder; James C. Davis, Jr.

[57] ABSTRACT

A permanent magnet assembly for use in magnetic resonance imagers requires a minimum of permanent magnet material. The magnets are arranged with a radial direction of magnetization and an iron return path is used. The specific configurations of the permanent magnets provide highly uniform magnetic fields in the bore of the assembly.

13 Claims, 7 Drawing Figures

RADIALLY MAGNETIZED CYLINDRICAL MAGNET

The present invention relates in general to an economical permanent magnet configuration for obtaining a uniform magnetic field in a cylindrical volume and more specifically to a permanent magnet assembly for magnetic resonance imaging which requires a reduced amount of permanent magnet material.

BACKGROUND OF THE INVENTION

Magnetic resonance imaging (MRI) systems require a uniform magnetic field and radio frequency radiation to cause magnetic resonance in the atomic nuclei of the subject being imaged. The magnetic resonance of the nuclei provides information from which an image of the portion of the subject containing these nuclei may be constructed. An exemplary method of MR imaging may be found in U.S. Pat. No. 4,471,306, assigned to the assignee of the present invention.

The magnetic field must be highly homogeneous, e.g. it should not vary more than several milligauss (1 gauss $=10^{-4}$ tesla) per centimeter, in order to obtain a meaningful image of the subject. Presently, both permanent magnets and superconducting magnets are used for generating such field. Among the advantages of permanent magnets are lower cost and a magnetic field which steeply drops off to near zero in the area outside of the magnet as distance from the magnet increases. The use of a permanent magnet instead of a superconducting magnet also eliminates the liquid helium needed to maintain the low temperature of a superconducting magnet.

Although permanent magnets allow realization of a cost savings over superconducting magnets, the permanent magnet materials used are expensive. In addition, the permanent magnets are very heavy due to the amount of material needed to provide the uniform magnetic field and to provide a flux return path within the permanent magnet volume. Present permanent magnet assemblies for MRI frequently require structural reinforcement in the building where they are installed due to their large mass.

OBJECTS OF THE INVENTION

It is a principal object of the present invention to provide a permanent magnet assembly for maintaining a uniform magnetic field in a cylindrical volume with a minimal amount of permanent magnet material.

It is a further object of the present invention to design a cost effective permanent magnet for MRI.

It is another object of the present invention to provide a magnetic flux return path outside of a permanent magnet volume.

SUMMARY OF THE INVENTION

These and other objects are achieved in a permanent magnet assembly for providing a region of substantially uniform flux density comprising a plurality of permanent magnet segments and a flux return path. The magnet segments have a constant magnetizing force $M_r$ and are arranged to circumferentially form a bore with a longitudinal axis. The magnet segments enclose the region of uniform flux density. Each magnet segment is magnetized in a direction substantially normal to the portion of the bore formed by the magnet segment. The flux return path radially encloses the permanent magnet segments.

In one embodiment, the bore has a constant radius $r_i(\theta)$ from the longitudinal axis (i.e. it is a cylinder) where $\theta$ is an angle measured from a radial reference line. The magnet segments occupy a first area between the bore and a first curve defined in each cross-section of the assembly through the region by a first vector $r_o(\theta)$ which extends from the longitudinal axis. The magnitude of $r_o(\theta)$ being equal to $r_i(\theta)/(1-|(B_y/M_r)\sin\theta|)$. The magnet segments are magnetized inwardly for $\theta$ between 0 and $\pi$ and outwardly for $\theta$ between $\pi$ and $2\pi$. The flux return path is comprised of a material capable of carrying a maximum magnetic flux density $B_r$ and occupies a second area between the first area and a second curve defined by $R_o(\theta)$. The magnitude of $R_o(\theta)$ equals $r_o(\theta)+|(B_y/B_r)\cos\theta|\ r_o(\theta)$.

BRIEF DESCRIPTION OF THE DRAWINGS

The novel features of the invention are set forth with particularity in the appended claims. The invention itself, however, as to organization and method of operation, together with further objects and advantages thereof, may best be understood by reference to the following description taken in conjunction with the accompanying drawings in which:

DETAILED DESCRIPTION OF THE INVENTION

Figure 1:
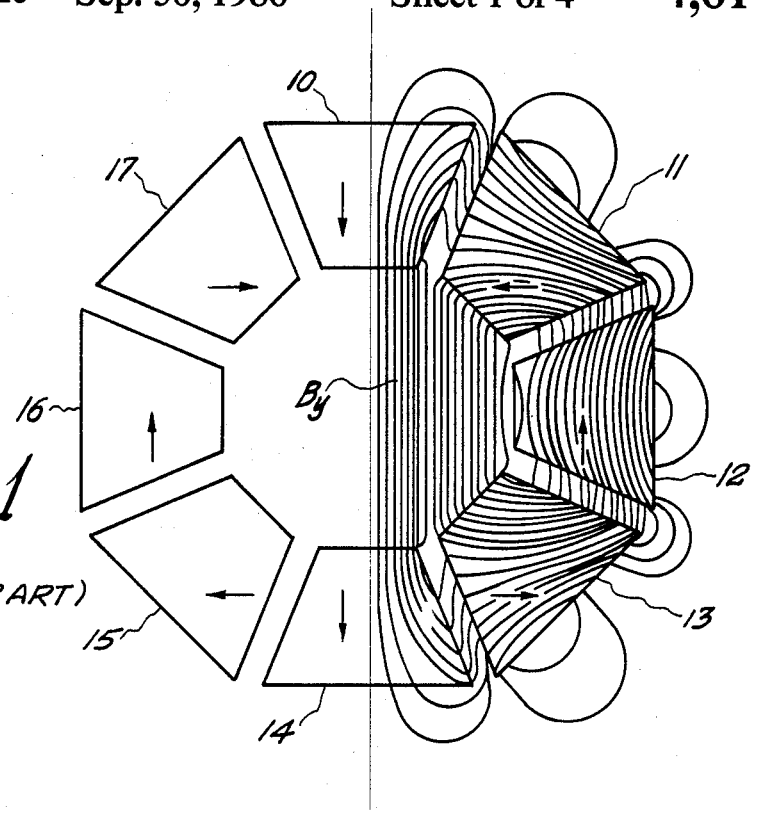
Fig. 1 (PRIOR ART)
FIG. 1 is a cross-sectional view of a prior art magnet configuration.

A prior art permanent magnet configuration for MRI is shown in cross section in FIG. 1. Magnet pieces 10–17 are arranged around an approximately cylindrical volume, each having a magnetizing force with a direction as shown by the arrows. The resulting lines of flux are shown for half of the configuration. A magnetic field is thus established in the interior of the assembly with a highly uniform flux density $B_y$ (where $B_y=\mu H_y$ and in the present discussion $\mu$ is assumed to be equal to 1). Nearly all of the flux return path is contained within the permanent magnets. For example, magnet piece 12 provides only return flux, although it is made of the same permanent magnet material.

A permanent magnet assembly 18, using an iron return path 23, and which reduces the amount of permanent magnet material required for values of $B_y/M_r$ below a certain limit, is shown in cross section in FIG. 2. A cylindrical bore 20 is provided which has a longitudinal axis 21 at its center. Thus, bore 20 has a constant radius $r_i(\theta)$, measured from axis 21. $\theta$ is an angle measured from radial line 19 where $\theta=0$ radians.

A permanent magnet material of constant magnetizing force $M_r$, to be contained in spaces 22, and a flux return path 23, creates a magnetic field within bore 20. Since assembly 18 must have less than infinite length, there is a cylindrical region within bore 20, of less than all of the area of bore 20 and less than all of the length of assembly 18, wherein the homogeneity of the magnetic field is acceptable for MR imaging. The area of this region is less than the area of the bore since truncating the length of assembly 18 causes non-uniformities in the magnetic field which are greatest near the truncated ends. A portion of this cylindrical region is shown in FIG. 2 by a field of uniform flux density $B_y$. For the present invention, $B_y$ cannot be greater than $M_r$.

Spaces 22, for containing the permanent magnets, are defined in each plane transverse to axis 21 which passes through the cylindrical region as the area between a circle of radius $r_i(\theta)$ with axis 21 at its center and a curve defined by a vector $r_o(\theta)$ extending from axis 21 and having a magnitude which is defined by the relationship:

$$r_o(\theta)=r_i(\theta)/(1-|(B_y/M_r)\sin\theta|).$$

Figure 2:
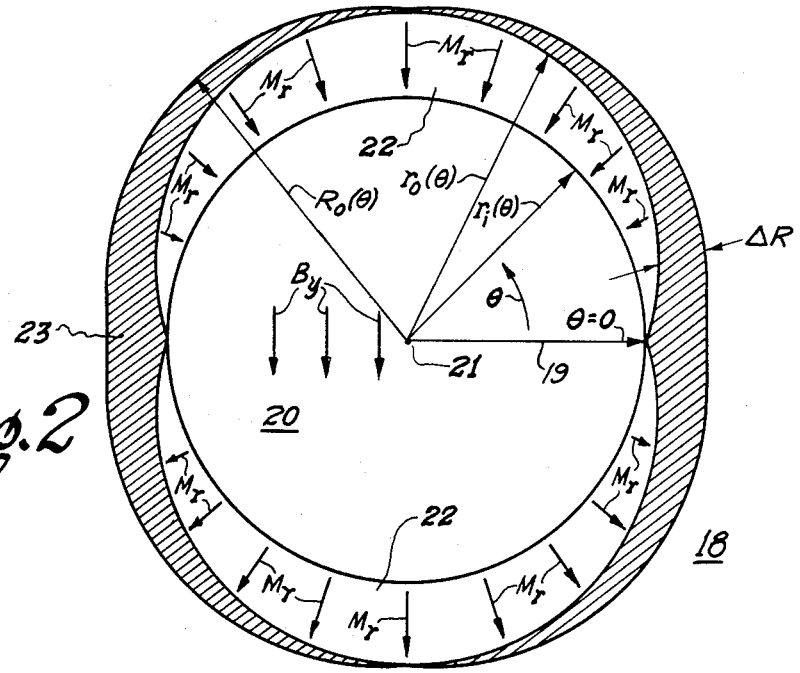
FIG. 2 is a front, cross-sectional view of the ideal dimensions of a permanent magnet and iron return path derived according to the present invention.

The configuration shown in FIG. 2 is drawn for a value of $B_y/M_r$ equal to 0.25. For example, one case of interest for MRI is $B_y=0.3$ tesla and $M_r=1.2$ tesla.

An important requirement of the permanent magnet material in spaces 22 is that it be magnetized normal to the interior surface of bore 20. For a bore field flux $B_y$ as shown in FIG. 2, the direction of magnetization in the permanent magnet material is radially inward for $\theta$ between 0 and $\pi$ and is radially outward for $\theta$ between $\pi$ and $2\pi$. Where $r_i(\theta)$ traces a circle, $M_r$ is also radial.

Flux return path 23 is characterized by an ability to carry a maximum flux density $B_r$, and may be comprised of iron. Thus, the value of $B_r$ will depend on the specific material used. Return path 23 occupies an area extending from the outer surface of spaces 22, and has a minimum radial thickness defined by $R_o(\theta)$ such that path 23 is able to carry the necessary flux to be returned. Thus, $R_o(\theta)$ is a vector with a magnitude of $r_o(\theta)$ plus an incremental amount $\Delta R$, and is determined according to the relationship $$R_o(\theta)\geqq r_o(\theta)+|(B_y/B_r)\cos\theta|r_o(\theta).$$

It will be understood by those skilled in the art that all vertical cross sections of permanent magnet assembly 18 which are in the longitudinally central portion of assembly 18 (i.e. those passing through the cylindrical region of uniform flux $B_y$) are identical.

Figure 3:
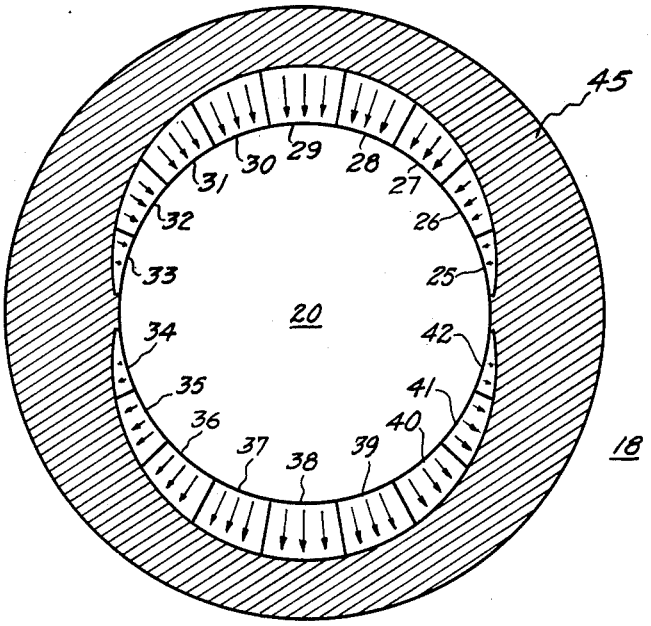
FIG. 3 is a front, cross-sectional view of a permanent magnet configuration for implementing the ideal design of FIG. 2.

A practical embodiment of the present invention for implementing the design of FIG. 2 is shown in FIG. 3, also in front cross section through the central portion of assembly 18. Thus, a plurality of permanent magnet segments 25–42 approximate spaces 22 of FIG. 2. Segments 25–42 extend in the longitudinal direction, although not necessarily the full longitudinal extent of spaces 22 (FIG. 2) if more segments are used. Spaces 22 are broken up into magnet segments 25–42 because it is not possible to conveniently obtain radially magnetized magnets. Thus, radial magnetization is approximated by a plurality of permanent magnet segments having parallel lines of magnetizing force $M_r$ as shown by the arrows in each magnet segment 25–42. Furthermore, iron return path 45 has been expanded for greater mechanical strength and ease of manufacture.

Figure 4:
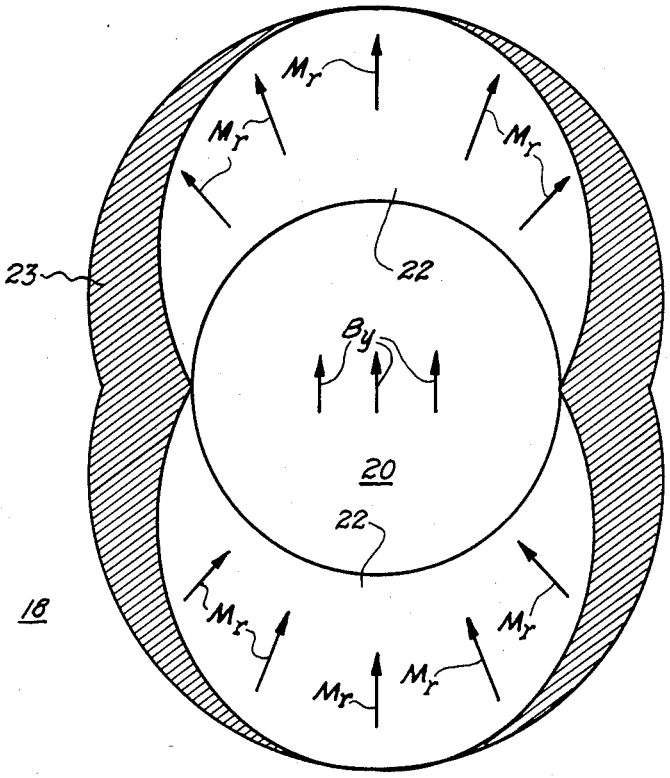
FIG. 4 is a front, cross-sectional view of the ideal dimensions of a further permanent magnet and iron return path for a configuration having a higher ratio of bore field flux to permanent magnet $M_r$ than the configuration of FIG. 2.

FIG. 4 shows that when the ratio $B_y/M_r$ is increased, the amount of permanent magnet material needed also is increased. In FIG. 4, dimensions are shown corresponding to $B_y/M_r$ equal to 0.5. Bore 20 has the same radius as in FIG. 2 (i.e. same $r_i(\theta)$) but the radial thickness defined by $r_o(\theta)$ is generally larger, in fact everywhere except at $\theta=0$ or $\pi$ where the radial thickness is zero for all cases.

Figure 5:
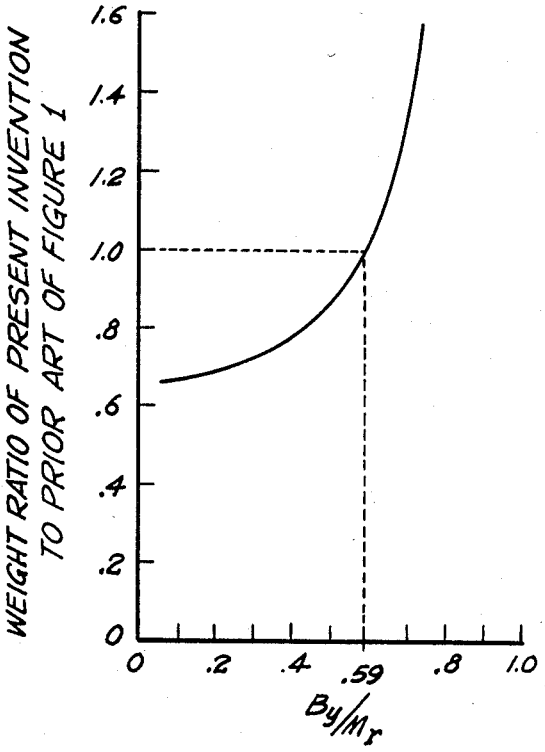
FIG. 5 is a graph showing the ratio of permanent magnet weight for the present invention to that of the arrangement of FIG. 1 for different values of the ratio of bore field flux to permanent magnet flux.

The savings in weight of permanent magnet material of the present invention over the prior art assembly of FIG. 1 is given in FIG. 5. A favorable weight ratio (permanent magnet weight of the present invention shown in FIG. 3 divided by permanent magnet weight of a prior art assembly as in FIG. 1) is seen to exist for values of $B_y/M_r$ less than about 0.59.

Figure 6:
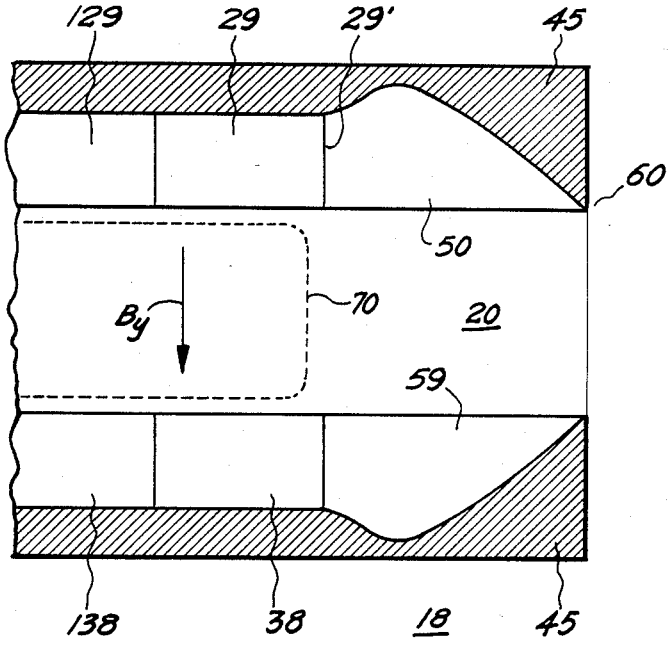
FIG. 6 is a side, cross-sectional view of the permanent magnet configuration of FIG. 3 showing an end modification for improving the homogeneity of the bore field flux.

The above described permanent magnet assembly exhibits a perfectly uniform flux density $B_y$ throughout its entire bore assuming that it is infinitely long in the longitudinal direction. Obviously, the assembly must be truncated and non-uniformities will be introduced in the magnetic field which are greatest near the truncated ends. The effect of truncation on $B_y$ in the cylindrical region in the longitudinally central portion of bore 20 can be reduced by changing the shape of spaces 22 (FIG. 2) near the truncated ends as shown in FIG. 6. Thus, moving toward the right from the right end 29' of magnet segment 29 to assembly end 60, $r_o(\theta)$ is multiplied by a factor which is constant in each cross-section and which first gradually increases and then gradually decreases to zero for different cross-sections. FIG. 6 shows that magnet segments 50 and 59 at the end of assembly 18 bulge and then taper to zero, thus improving the uniformity of $B_y$ in cylindrical region 70 within magnet segments 29, 38, 129 and 138, for example. The amount of tapering and bulging will depend on the size of magnet assembly 18 and is not necessarily unique. Thus, it is straightforward to vary these parameters to obtain the desired homogeneity and size of region 70. Further, it will be apparent that iron return path 45 will still extend from $r_o(\theta)$ to $R_o(\theta)$ as $r_o(\theta)$ varies along the length of assembly 18.

Figure 7:
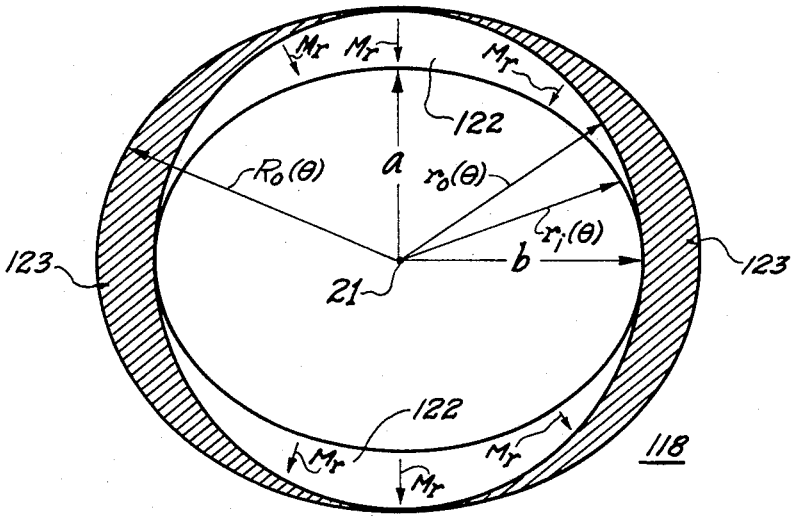
FIG. 7 is a front, cross-sectional view of another embodiment of the present invention having an elliptical bore.

The present invention may also be extended to an assembly 118, shown in FIG. 7, having an elliptical bore (i.e. $r_i\theta 0$) varies with $\theta$ to trace an ellipse). The theoretical direction of magnetizing force $M_r$, rather than being in the radial direction as with a cylindrical bore, in this instance lies along the lines of a set of confocal hyperbolas, i.e. hyperbolas with the same foci. Since that magnetization cannot be conveniently obtained in practice, magnet segments with $M_r$ normal to the surface of the ellipse are used as shown in FIG. 7. As measured from axial line 21, $r_i(\theta)$ for the elliptical bore is $$((a\cdot\sin\theta)^2+(b\cdot\cos\theta)^2)^{\frac{1}{2}},$$

where a is the semi-minor axis and b is the semi-major axis of the ellipse. Magnet spaces 122 lie between $r_i(\theta)$ and $r_o(\theta)$, where $r_o(\theta)$ is defined as:

$$r_o(\theta)=r_i(\theta)/(1;31\ |(B_y/M_r)\sin\theta|).$$

This relationship is the same as for the cylindrical case except that $r_i(\theta)$ now traces an ellipse.

The minimum area for the flux return path 123 lies between $r_o(\theta)$ and $R_o(\theta)$, where $R_o(\theta)$ is now defined as:

$$R_o(\theta) \geqq ((a \cdot \sin\theta)W^2 + (b(1+B_y/B_r)\cos\theta)^2)^{\frac{1}{2}}.$$

Thus, FIG. 7 shows each cross-section of magnet assembly 118 which includes the region of uniform flux $B_y$. The uniformity of $B_y$ is likewise improved by modifying the truncated ends as described for the case of a cylindrical bore.

Suitable permanent magnet materials for the magnet segments include ferrite ceramics, rare-earth cobalts and neodymium alloys. Flux return path 23 or 45 may also be constructed from magnetic materials other than iron.

The foregoing describes a permanent magnet assembly which maintains a uniform and highly homogeneous magnetic field in a cylindrical volume while reducing the amount of permanent magnet material used whenever $B_y/M_r$ is less than 0.59. The assembly is useful for MR imaging or any other application requiring a uniform magnetic field.

While preferred embodiments of the present invention have been shown and described herein, it will be obvious that such embodiments are provided by way of example only. Numerous variations, changes and substitutions will occur to those skilled in the art without departing from the invention herein. Accordingly, it is intended that the invention be limited only by the spirit and scope of the appended claims.

What is claimed is:

1. A permanent magnet assembly for providing a region of substantially uniform flux density, said assembly comprising:

a plurality of permanent magnet segments of substantially constant magnetizing force $M_r$ circumferentially enclosing a bore with a central longitudinal axis, said bore including said region, and each of said magnet segments being magnetized in a direction substantially normal to the portion of said bore enclosed by each respective magnet segment; and a flux return path radially enclosing said permanent magnet segments.

2. The assembly of claim 1 wherein said bore has a constant radius $r_i(\theta)$ from said longitudinal axis where $\theta$ is an angle measured from a radial reference line, said magnet segments occupying a first area between said bore and a first curve defined in each cross-section of said assembly through said region by a first vector $r_o(\theta)$ extending from said longitudinal axis, the magnitude of $r_o(\theta)$ being $r_i(\theta)/(1-|(B_y/M_r)\sin\theta|)$, and wherein each of said magnet segments is magnetized inwardly toward said bore in the portion of said first area defined for $\theta$ between 0 and $\pi$ and outwardly from said bore in the portion of said first area defined for $\theta$ between $\pi$ and $2\pi$.

3. The assembly of claim 2 wherein said flux return path carries a flux density $B_r$ and occupies at least a second area between said first area and a second curve defined in each cross-section of said assembly through said region by a second vector $R_o(\theta)$ extending from said longitudinal axis, the magnitude of $R_o(\theta)$ being $r_o(\theta)+(B_y/B_r)\cos\theta|r_o(\theta)$.

4. The assembly of claim 1 wherein said bore has an elliptical radius $r_i(\theta)$ from said longitudinal axis where $\theta$ is an angle measured from a radial reference line and where $r_i(\theta)=((a\cdot\sin\theta)^2+(b\cdot\cos\theta)^2)^{\frac{1}{2}}$, a being the semi-minor axis and b being the semi-major axis of said bore, said magnet segments occupying a first area between said bore and a first curve defined in each cross-section of said assembly through said region by a first vector $r_o(\theta)$ extending from said longitudinal axis, the magnitude of $r_o(\theta)$ being $r_i(\theta)/(1-|(B_y/M_r)\sin\theta)$, and wherein each of said magnet segments is magnetized inwardly toward said bore in the portion of said first area defined for $\theta$ between 0 and $\pi$ and outwardly from said bore in the portion of said first area defined for $\theta$ between $\pi$ and $2\pi$.

5. The assembly of claim 4 wherein said flux return path carries a flux density $B_r$ and occupies at least a second area between said first area and a second curve defined in each cross-section of said assembly through said region by a second vector $R_o(\theta)$ extending from said longitudinal axis, the magnitude of $R_o(\theta)$ being $((a\cdot\sin\theta)^2+(b(1+B_y/B_r)\cos\theta)^2)^{\frac{1}{2}}$.

6. A permanent magnet assembly for providing a substantially uniform magnetic field of flux density $B_y$ in a substantially cylindrical region, said assembly comprising:

a plurality of permanent magnet segments of substantially constant magnetizing force $M_r$ circumferentially enclosing a cylindrical bore of radius $r_i(\theta)$ having a central longitudinal axis and $\theta$ being an angle measured from a radial reference line, said bore including said cylindrical region, said segments occupying a space, at least radially outward of said cylindrical region, defined as the area between $r_i(\theta)$ and a curve $r_o(\theta)$, where $r_o(\theta)=r_i(\theta)/(1-|(B_y/M_r)\sin\theta|)$, each of said segments being substantially radially magnetized in one direction for $\theta$ between 0 and $\pi$ and in the opposite direction for $\theta$ between $\pi$ and $2\pi$; and a flux return path of a magnetic material capable of carrying a maximum flux density $B_r$, said return path being external of and adjacent to said space and having an outside surface of radius $R_o(\theta)$ greater than or equal to $r_o(\theta)+|(B_y/B_r)\cos\theta|r_o(\theta)$.

7. The permanent magnet assembly of claim 6 wherein the radial thickness of said space tapers toward zero at both longitudinal ends of said assembly proportionally for all values of $\theta$.

8. The permanent magnet assembly of claim 7 wherein the radial thickness of said space is increased proportionally for all values of $\theta$ between that part of said space which is radially outward of said cylindrical region and each of said longitudinal ends, whereby a pair of bulges are formed in said space adjacent each of the tapered ends.

9. The permanent magnet assembly of claim 6 wherein said magnetic material in said flux return path comprises iron.

10. A permanent magnet assembly for providing a substantially uniform magnetic field of flux density $B_y$ in a substantially elliptical region, said assembly comprising:

a plurality of permanent magnet segments of substantially constant magnetizing force $M_r$ circumferentially enclosing an elliptical bore of radius $r_i(\theta)$ having a longitudinal axis, said bore having a semi-minor axis a and a semi-major axis b, and $\theta$ being an angle measured from a radial reference line, said bore including said elliptical region, said segments occupying a space, at least radially outward of said elliptical region, defined as the area between $r_i(\theta)$ and a curve $r_o(\theta)$, where $r_i(\theta)=((a\cdot\sin\theta)^2+(b\cdot\cos$ $\theta)^2)^{\frac{1}{2}}$ and $r_o(\theta)=r_i(\theta)/(1-|(B_y/M_r)\sin\theta|)$, each of said segments being magnetized substantially normal to said elliptical bore and in one direction for $\theta$ between 0 and $\pi$ and in the opposite direction for $\theta$ between $\pi$ and $2\pi$; and a flux return path of a magnetic material capable of carrying a maximum flux density $B_r$, said return path being external of and adjacent to said space and having an outside surface of radius $R_o(\theta)$ greater than or equal to $((a\cdot\sin\theta)^2+(b(1+B_y/B_r)\cos\theta)^2)^{\frac{1}{2}}$.

11. The permanent magnet assembly of claim 10 wherein the radial thickness of said space tapers toward zero at both longitudinal ends of said assembly proportionally for all values of $\theta$.

12. The permanent magnet assembly of claim 11 wherein the radial thickness of said space is increased proportionally for all values of $\theta$ between that part of said space which is radially outward of said elliptical region and each of said longitudinal ends, whereby a pair of bulges are formed in said space adjacent each of the tapered ends.

13. The permanent magnet assembly of claim 10 wherein said magnetic material in said flux return path comprises iron.

* * * * *